US005197555A

United States Patent [19]

Estes

[11] Patent Number: 5,197,555

[45] Date of Patent: Mar. 30, 1993

[54] ROCK BIT WITH VECTORED INSERTS

[75] Inventor: Roy D. Estes, Weatherford, Tex.

[73] Assignee: Rock Bit International, Inc., Fort Worth, Tex.

[21] Appl. No.: 704,056

[22] Filed: May 22, 1991

[51] Int. Cl.[5] ..... E21B 10/52

[52] U.S. Cl. ..... 175/431

[58] Field of Search ..... 175/374, 375, 410, 376, 175/329, 336, 6, 377, 431

[56] References Cited

U.S. PATENT DOCUMENTS

| | | | |
|---|---|---|---|
| 3,495,668 | 2/1970 | Schumacher, Jr. | 175/341 |
| 3,696,876 | 10/1972 | Ott | 175/374 |
| 4,058,177 | 11/1977 | Langford, Jr. et al. | 175/410 X |
| 4,086,973 | 5/1978 | Keller et al. | 175/410 X |
| 4,108,260 | 8/1978 | Bozarth | 175/374 |
| 4,334,586 | 6/1982 | Schumacher | 175/374 |
| 4,343,371 | 8/1982 | Baker, III et al. | 175/374 X |
| 4,359,335 | 11/1982 | Garner | 175/410 X |
| 4,393,948 | 7/1983 | Fernandez | 175/374 |
| 4,420,050 | 12/1983 | Jones | 175/374 |
| 4,475,606 | 10/1984 | Crow | 175/410 |
| 4,832,139 | 5/1989 | Minikus et al. | 175/374 |

*Primary Examiner*—Ramon S. Britts
*Assistant Examiner*—Frank S. Tsay
*Attorney, Agent, or Firm*—Arnold, White & Durkee

[57] ABSTRACT

An improved rotary cone cutter for rock drill bits having circumferential rows of wear resistant inserts. Inserts on the two outermost rows are oriented at an angle in relationship to the axis of the cone to either the leading side or trailing side of the cone. Such orientation will achieve either increased resistance to insert breakage and/or increased rate of penetration.

24 Claims, 2 Drawing Sheets

ROCK BIT WITH VECTORED INSERTS

FIELD OF INVENTION

This invention relates, in general, to earth boring rotary cone rock bits used in oil field applications. More particularly, the invention relates to an improved design and arrangement of wear resistant inserts to achieve improved rates of penetration and/or improved resistance to insert breakage.

BACKGROUND OF THE INVENTION

This invention relates to earth boring rotary cone rock bits used in oil field applications. These bits have a body with two or more journal segment arms with rotary cone cutters mounted thereon. The cutters are mounted on bearing pin shafts which extend downwardly and inwardly from the journal segment arms. These bits are conventionally attached to hollow drill pipes and suspended downwardly from a drilling rig at the surface. Rotational energy and weight applied to the bit by the drill pipe force the rotary cutters into earth formations. Borehole is formed as the punching and scraping action of the rotary cutters remove chips of formation. These chips are carried away by fluid forced down through the drill pipe and bit. The fluid carries chips and cuttings with it as it flows up and out of the borehole.

The rate at which borehole is formed is largely a result of the design of the rotary cutters. There are two main categories of rotary cutters; milled tooth cutters and tungsten carbide insert (TCI) cutters. The teeth on milled tooth cutters are integral parts of the cone and are formed by a milling operation, hence the name. The teeth on TCI cutters are made of tungsten carbide and are press fit (inserted) into undersize apertures on the cone. The teeth on the cutters functionally break up the formation to form new borehole by punching into it vertically and scraping horizontally. The amount of punching action is governed primarily by the weight on the bit. The horizontal scraping motion is a resultant of the position and shape of the cone cutter.

Medium and soft formation bits usually drill through varied formations in a single well. Recording devices which show instantaneous rates of penetration will often show rates as high as four feet per minute and rates as slow as one foot in ten minutes on the same bit run. As a rule, the formations tend to become harder as depth increases but there are large variations in hardness at all depths.

Bits having long inserts are most efficient for fast drilling in soft formations. In the very soft formations the penetration rate of a bit is limited by the length of its inserts. When the full length of the insert penetrates into the formation the steel body of the cone forces against the formation and limits further penetration. Long inserts are relatively weak though, and are subject to breakage in the slower drilling hard formations. Short blunt inserts are better suited for the harder formations because they are less subject to breakage, but they limit a bit's penetration rate in soft formations. Numerous attempts have been made to reduce the insert breakage without compromising the penetration rate of the bit. Examples are shown in U.S. Pat. No. 4,108,260 to Bozarth, U.S. Pat. Nos. 4,334,586 and 3,495,668 to Schumacher, and U.S. Pat. No. 3,696,876 to Ott. All of these attempted to prevent or reduce the breakage by making the points of the inserts blunter.

On most modern tri-cone rotary rock bits the cones are positioned such that the axis or centerline of the cones do not intersect the centerline of the borehole and rock bit. They are offset with the cone centerline leading the bit centerline. (Leading and trailing are common rock bit terms used to describe positions. The side of an object that is facing the direction of rotation is referred to as the leading side. The side of an object that is facing opposite the direction of rotation is referred to as the trailing side.) U.S. Pat. No. 3,495,668 to Schumacher discloses a bit with offset or skewed roller cutters. This offset causes any point on a cone to be farther from the bit centerline before that point touches the bottom of the borehole than after. This offset position of the cone cutter causes any insert engaging formation to scrape inboard or toward the bit centerline as the bit rotates.

The arcuate shape of the cone causes circumferential drag of the inserts. Each row of inserts would have a different rotational rate based on the diameter of each row and the distance of each row from the center of the bit if each row were free to rotate independently. Because the rows are locked together the inserts of some rows will scrape toward the leading side and the inserts of the other rows will scrape toward the trailing side.

The theoretical horizontal scraping motion of the inserts inboard and circumferentially can be calculated. However, the actual rotation rate of a cone is a resultant of the forces acting on each insert embedded in formation and is somewhat jerky rather than constant. Calculations indicate that most rotary cone TCI bits have a common scraping pattern. The outermost row (heel row) on each cone usually scrapes toward the leading side and the next row inboard from the outermost row usually scrapes toward the trailing side. The two outer rows of the cutters combined account for more than 50% of the borehole area cut by most TCI rock bits. Therefore the design and function of this area of TCI bits is very critical.

Most of the TCI bits used for drilling soft to medium hard formations utilize tungsten carbide inserts having a chisel shape with an elongated crest at the top. Chisel shaped inserts are well known in the art of TCI bits. TCI bits utilizing inserts having elongated crests have generally been built with the lengthwise centerline of the crests relatively in line with the axis of the cone cutter. U.S. Pat. No. 4,393,948 to Fernandez teaches a relatively random orientation of the crests of inserts on cone cutters. Milled tooth bits have been built with the gage of one cone oblique to the leading side and the gage row of another cone oblique to the trailing side. This arrangement on milled tooth bits provides "cross hatched" impressions on the borehole bottom to minimize tracking. Tracking is detrimental drilling condition that develops when teeth from one cone fall into the impression of teeth made by another cone.

SUMMARY OF THE INVENTION

This invention provides a novel orientation of wear resistant inserts in the outer two rows of the rolling cone cutters to improve the rate of penetration and/or improve the resistance to insert breakage.

The discussion above described the most common motion of TCI rolling cone cutter inserts as they engage formation. The inserts scrape diagonally inboard and either to the leading side or to the trailing side. Most TCI bits used in soft and medium formations have inserts with elongated crests oriented with the axis of the cutter. Therefore the insert crests of this type bit moves in the formation relatively diagonally to the centerline of the crest.

Logical evaluation of chisel shaped inserts and their function indicates either of two types of chip formation can be maximized by crest orientation. If the insert moves in formation in a direction in line with the elongated crest a relatively small area of the insert forces against the formation and relatively small chips are formed. The insert breaks formation somewhat like a conical shaped insert. The relatively thick section of tungsten carbide along the length of the crest provides a very high resistance to insert breakage. This type insert orientation provides a cone cutter with much higher resistance to breakage than a similar cutter with standard insert orientation. Cutters with higher resistance to breakage can withstand higher energy input (higher weight on bit and/or higher rotational speed) and can be used to drill harder formations.

Orientation of the insert crest along the direction of insert motion improves the inserts resistance to breakage in hard formations. Bits designed according to this invention can operate efficiently in the soft formations and withstand harder formations better than bits designed according to prior art.

If the insert moves in formation relatively perpendicular to the elongated crest a relatively large area of the insert forces against the formation. This orientation will cause the insert to break formation along a wider path making more chips and larger chips than the standard orientation. Bits with cutters having inserts oriented in this manner will drill faster in soft formations than similar bits having cutters with standard orientation.

This invention provides an improved rotary rock bit cone cutter having chisel shaped inserts with the inserts oriented in such a manner to make them more breakage resistant.

This invention also provides an improved rotary rock bit cone cutter having chisel shaped inserts with the inserts oriented in such a manner to cause the bit to drill faster and more efficiently than conventional TCI bits.

Another embodiment of the invention provides an improved rotary rock bit cone cutter having milled steel teeth oriented in such a manner to make them more resistant to breakage or in such a manner to increase the penetration rate of the bit.

DESCRIPTION OF THE PREFERRED EMBODIMENTS

Figure 1:
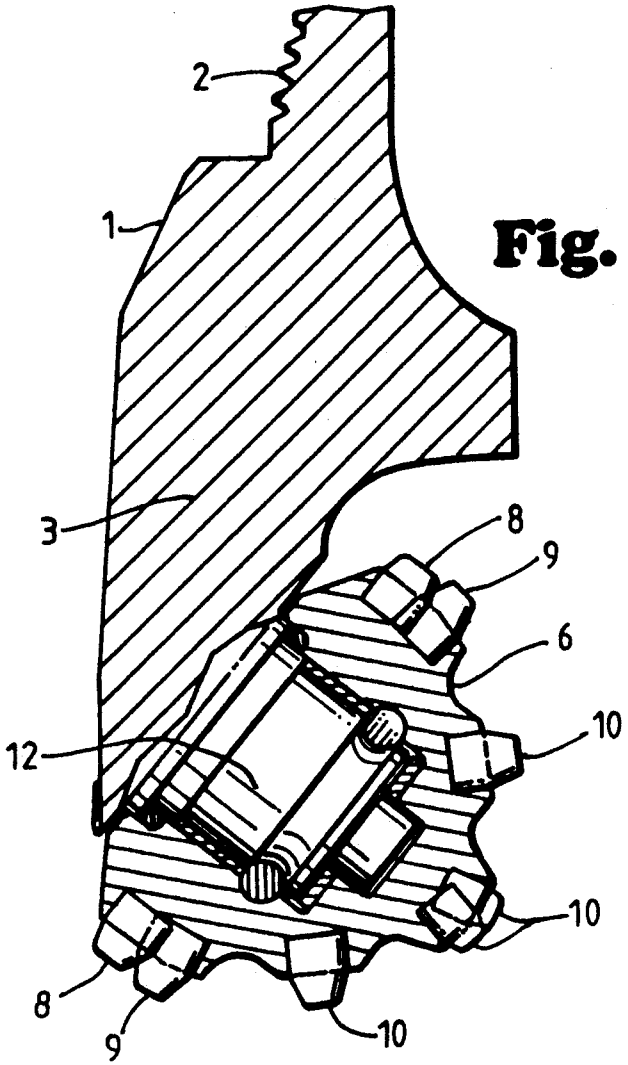
FIG. 1 is a cross sectional view of a portion of a TCI tri-cone rock drill bit showing one cone cutter rotatably mounted on a bearing pin shaft.

Referring to FIG. 1, drill bit 1 has a threaded section 2 on its upper end for securing to the drill string (not shown). A frusto-conical rolling cone cutter 6 with a cutting structure consisting of wear resistant heel inserts 8, second row inserts 9, and inner inserts 10, is rotatably mounted and secured on the bearing pin shaft 12 which extends downward and inward, from the bottom of the journal segment arm 3. The cone cutters are rotatably mounted on journals with sliding bearing surfaces. The axis of rotation of the cone cutter extends inwardly through the center of the bearing pin shaft toward and offset from the axis of rotation of the drill bit.

Figure 2:
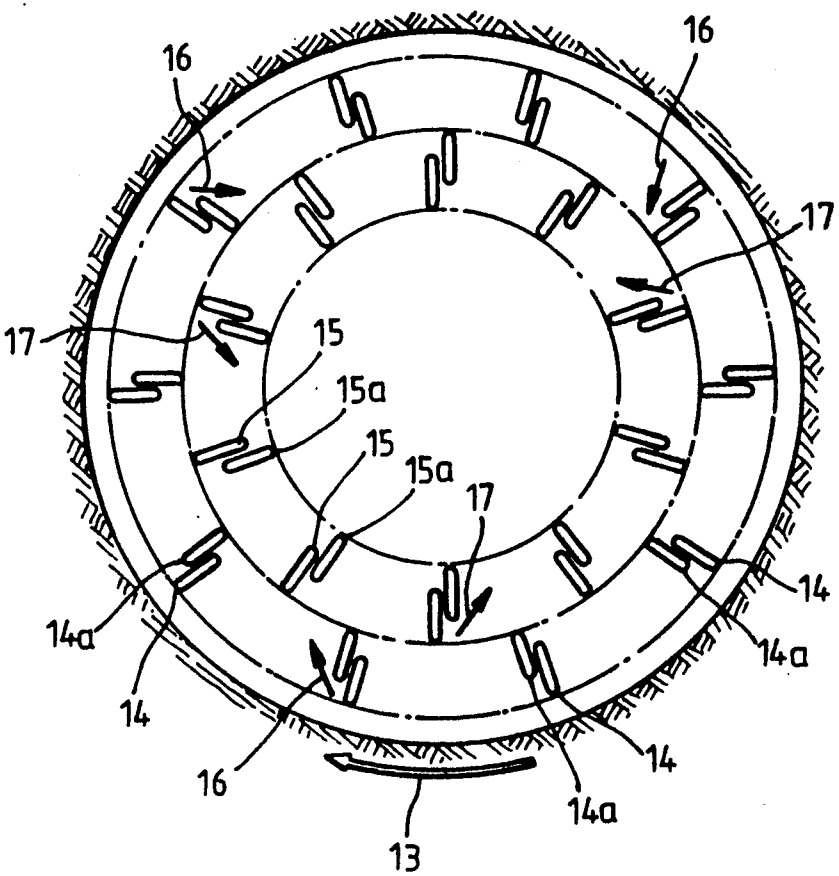
FIG. 2 is a schematic view of a bore hole bottom showing insert tracks left by a standard TCI bit.

FIG. 2 is a schematic view of a bore hole bottom showing insert tracks left by one cone cutter on a standard tri-cone TCI bit with chisel shaped inserts aligned with the axis of the cone. FIG. 2 shows the impression left by each insert of the two outer rows. For each impression the chisel crest position is shown when the insert first engages formation and which it disengages.

The direction of bit rotation is indicated by arrow 13. The chisel crest of the insert initially engages the formation as indicated by 14 on the heel row and 15 on the second row and scrapes across the formation in the direction indicated by arrows 16 and 17. Heel row inserts 14 are scraping the formation in a direction toward the leading side of the cone while the inserts 15 are scraping formation in a direction toward the trailing side of the cone. The insert's chisel crest disengages the formation at 14*a* on the heel row and 15*a* on the second row.

Figure 3:
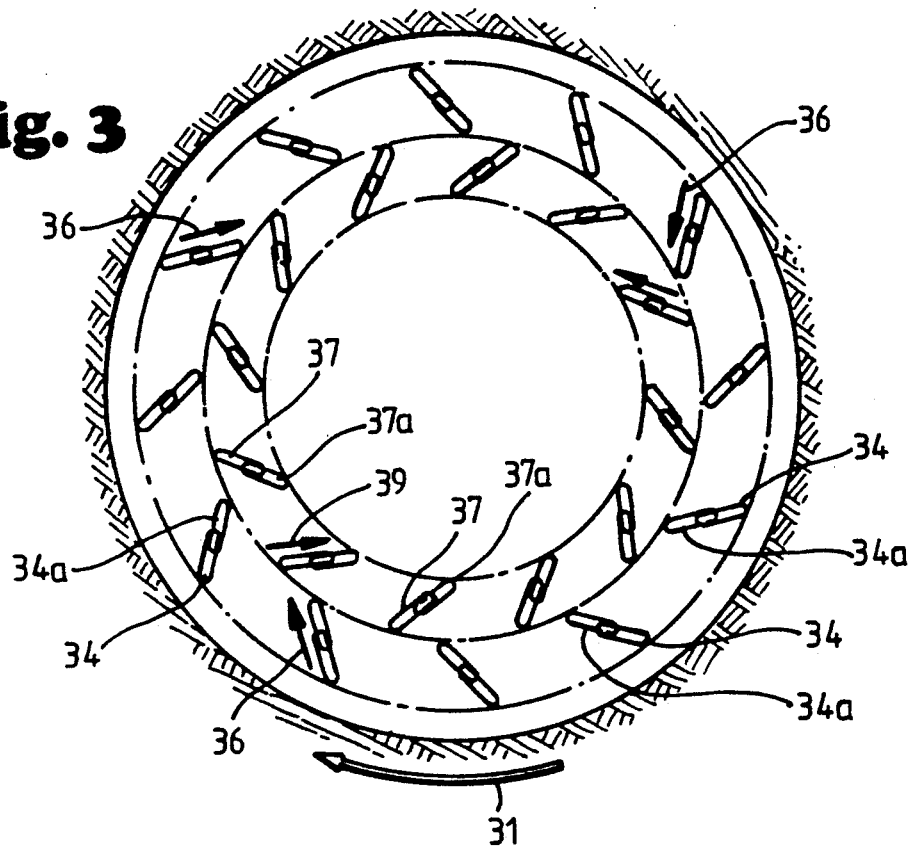
FIG. 3 is a schematic view of a bore hole bottom showing insert tracks left by a preferred embodiment for reducing insert breakage.

By orienting (vectoring) the elongated crest of the inserts in line with the insert movement a chisel insert presents a very small face to the formation. The insert can withstand higher forces (or harder formations) in this situation. This is illustrated in FIG. 3 which is a schematic view of a borehole bottom showing insert tracks left by chisel shaped inserts oriented for reducing insert breakage. The inserts are oriented (vectored) at an angle to the axis of the cone. The elongated crests of the chisel shaped heel row inserts are at an angle from 30 to 60 degrees from the axis of rotation of the cone toward the leading side of the cone. The elongated crests of the second row inserts are at an angle from 30 to 60 degrees from the axis of the cone toward the trailing side of the cone. Stated another way, the elongated crests on the heel row are oriented at an azimuth direction ranging from 300 to 330 degrees from the axis of rotation of the cone with the axis being equal to 360°. The elongated crests on the second row are oriented at an azimuth direction of 30 to 60 degrees from the axis of the cone.

With such an orientation, the insert moves in formation in a direction in line with the elongated crest so that a relatively small area of the insert contacts the formation and relatively small chips are formed. The relatively thick section of tungsten carbide along the length of the crest provides a very high resistance to insert breakages. This type of insert orientation provides a cone cutter with much higher resistance to breakage than a similar cutter with conventional insert orientation.

FIG. 3 shows the impression left by the chisel crest inserts on the two outer rows of a cone cutter. The direction of bit rotation is indicated by arrow 31. The initial engagement of the elongated crests of the heel row inserts is indicated by 34. The disengagement of the elongated crests of the heel row inserts is indicated by 34*a* with the direction of the scraping of formation represented by arrow 36. The elongated crests of the second row inserts engage 37 and disengage 37*a* the formation in the direction indicated by arrow 39.

Figure 4:
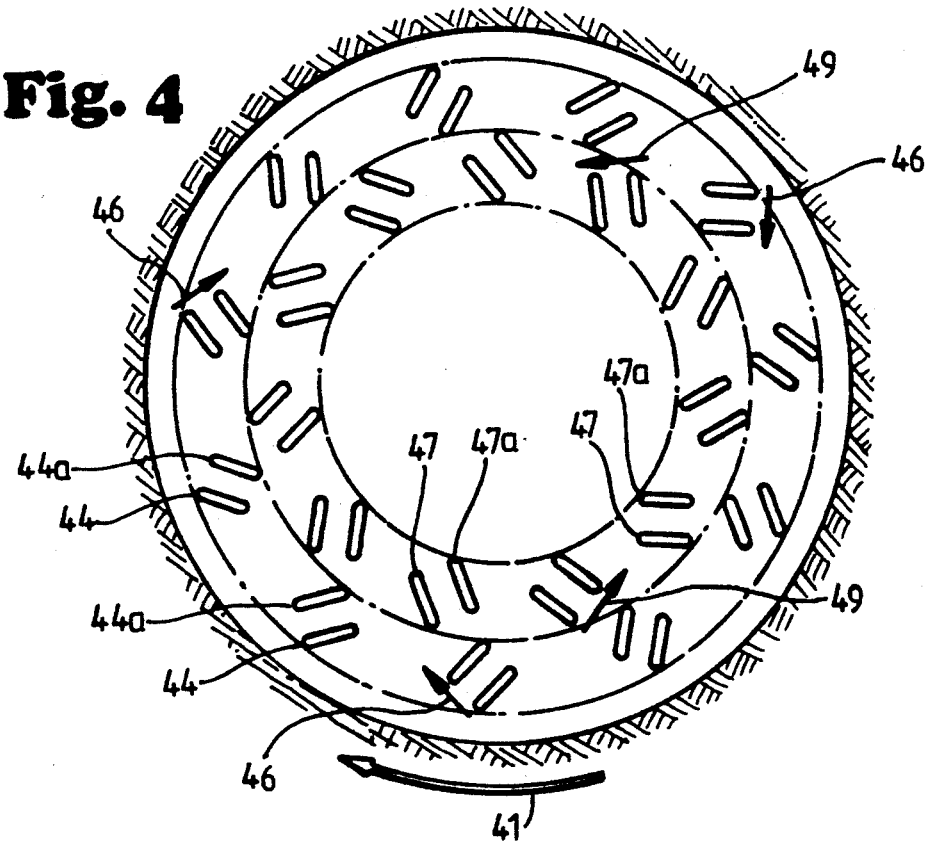
FIG. 4 is a schematic view of a bore hole bottom showing insert tracks left by a preferred embodiment for increasing penetration rate.

By orienting or vectoring the crest so that the broad side of the insert crest faces the direction of scrape, each insert removes more formation, resulting in a faster penetration rate. This is illustrated in FIG. 4 which is a schematic view of a borehole bottom showing insert tracks left by chisel shaped inserts oriented for increasing penetraton rate. As shown in FIG. 4, the elongated crests of the chisel crested inserts are relatively perpendicular to the direction of the scraping action. The elongated crests of the heel row inserts are oriented at an angle of 30 to 60 degrees toward the trailing side of the cone. The elongated crests of the second row inserts are oriented at an angle of 30 to 60 degrees toward the leading side of the cone. Stated another way, the elongated crests of the heel row inserts are oriented at an azimuth direction ranging from about 30 to 60 degrees from the axis of rotation of the cone. The elongated crests of the second row inserts are oriented at an azimuth direction of 300 to 330 degrees from the axis of rotation of the cone with the axis being equal to 360°. This orientation will break formation along a wider path making more chips and larger chips than orientation of standard TCI bits resulting in an increase penetration rate.

FIG. 4 shows the impressions left by the chisel crested inserts on the two outer rows of a cone cutter. The direction of bit rotation is indicated by arrow 41. The initial engagement of the elongated crests of the heel row inserts is indicated by 44. The disengagement of the elongated crests of the heel row inserts is indicated by 44*a* with the direction of the scraping of formation represented by arrow 46. The elongated crests of the second row inserts engage 47 and disengage 47*a* the formation in the direction indicated by arrow 49.

Bits incorporating the embodiments of this invention were tested with positive results. Breakage of the inserts was nil when run under conditions where breakage had previously been encountered. The forces normally acting to cause the outer or drive rows to gear or lock to the formation and impart a scraping action to the inner rows was found to be reduced. This produced an interaction between the drive rows and the inner rows that resulted in slippage. As a result, the inserts exhibited wear termed "self-sharpening" by the industry. The lack of breakage and the self-sharpening results in longer bit life with sustained or even increased penetration rates in the later stages of the bit life.

Another embodiment of this invention has dome, conical or blunt chisel shaped inserts in the heel row. The second row inserts are chisel crested inserts. The crests of the second row inserts can be oriented in the configurations described above in order to achieve improved resistance to insert breakage or improved penetration rates. The orientation of the dome, conical or blunt chisel inserts in the heel row is not critical. The elongated crest of a blunt chisel insert is wider than the crest of a normal chisel shaped insert. This embodiment is generally used to drill hard formations.

The innermost rows of wear resistant inserts can also be oriented according to the direction of scrape for each row. Although the orientation of the inserts on the innermost rows is not as critical as the outer two rows, the orientation of the innermost inserts can also increase the resistance to insert breakage and/or increase the penetration rate of a bit.

Although the detailed description and related figures are directed to roller cone cutters with wear resistant inserts, the principles of this invention apply equally to milled tooth cutters. Thus, the teeth can be milled into the cone at such an orientation to make them more resistant to breakage and/or to increase the penetration rate of the bit. The angle of orientation of the steel teeth would be comparable to the angle of orientation set forth above for wear resistant inserts.

On steel tooth bits, the orientation of heel row teeth is more critical than the inner rows. The heel teeth on all cones of a bit should be oriented to improve penetration rate or to prevent breakage. The heel row teeth on all cones are oriented alike, unlike some prior art bits which had heel teeth on different cones oriented at angles contrary to each other to minimize tracking.

Although several embodiments of the invention have been illustrated in the accompanying drawings and described in the foregoing Description of the Preferred Embodiments, it will be understood that the invention is not limited to the embodiments disclosed, but is capable of rearrangements, modifications and substitutions without departing from the scope of the invention.

What is claimed is:

1. An improved roller cone cutter, the cutter being adapted for mounting on a bearing pin shaft on a roller cone rock drill bit, the axis of rotation of the improved cutter extending inwardly and through the center of the bearing pin shaft toward and offset from the axis of rotation of the drill bit, the improved roller cone cutter comprising:

a circumferential outermost heel row of wear resistant chisel shaped inserts with elongated crests;

the chisel shaped inserts in the heel row being oriented with the elongated crests at an azimuth direction from about 30 to 60 degrees from the axis of rotation of the cone cutter;

a circumferential second row of wear resistant chisel shaped inserts with elongated crests, the second row being adjacent to the inward side of the heel row;

the chisel shaped inserts in the second row being oriented with the elongated crests at an azimuth direction from about 300 to 330 degrees from the axis of rotation of the cone cutter; and a plurality of circumferential inner rows of wear resistant chisel shaped inserts, the inner rows being adjacent to the inward side of the second row of inserts.

2. The improved roller cone cutter of claim 1 wherein the chisel shaped inserts of the inner rows are oriented at an azimuth direction to the axis of rotation of the cone cutter according to the direction of scraping action for the inner rows.

3. An improved roller cone cutter, the cutter being adapted for mounting on a bearing pin shaft on a roller cone rock drill bit, the axis of rotation of the improved cutter extending inwardly and through the center of the bearing pin shaft toward and offset from the axis of rotation of the drill bit, the improved roller cone cutter comprising:

a circumferential outermost heel row of wear resistant chisel shaped inserts with elongated crests;

the chisel shaped inserts in the heel row being oriented with the elongated crests at an azimuth direction from about 300 to 330 degrees from the axis of rotation of the cone cutter;

a circumferential second row of wear resistant chisel shaped inserts with elongated crests, the second row being adjacent to the inward side of the heel row;

the chisel shaped inserts in the second row being oriented with the elongated crests at an azimuth direction from about 30 to 60 degrees from the axis of rotation of the cone cutter; and a plurality of circumferential inner rows of wear resistant chisel shaped inserts, the inner rows being adjacent to the inward side of the second row of inserts.

4. The improved roller cone cutter of claim 3 wherein the chisel shaped inserts of the inner rows are oriented at an azimuth direction to the axis of rotation of the cone cutter according to the direction of scraping action for the inner rows.

5. An improved roller cone cutter, the cutter being adapted for mounting on a bearing pin shaft on a roller cone rock drill bit, the axis of rotation of the improved cutter extending inwardly and through the center of the bearing pin shaft toward and offset from the axis of rotation of the drill bit, the improved roller cone cutter comprising:

a circumferential outermost heel row of wear resistant inserts;

a circumferential second row of wear resistant chisel shaped inserts with elongated crests, the second row being adjacent to the inward side of the heel row;

the chisel shaped inserts in the second row being oriented with the elongated crests at an azimuth direction from about 30 to 60 degrees from the axis of rotation of the cone cutter; and a plurality of circumferential inner rows of wear resistant chisel shaped inserts, the inner rows being adjacent to the inward side of the second row of inserts.

6. The improved roller cone cutter of claim 5 wherein the chisel shaped inserts of the inner rows are oriented at an azimuth direction to the axis of rotation of the cone cutter according to the direction of scraping action for the inner rows.

7. The improved roller cone cutter of claim 5 wherein the inserts of the heel row are comprised of dome, conical or blunt chisel inserts.

8. An improved roller cone cutter, the cutter being adapted for mounting on a bearing pin shaft on a roller cone rock drill bit, the axis of rotation of the improved cutter extending inwardly and through the center of the bearing pin shaft toward and offset from the axis of rotation of the drill bit, the improved roller cone cutter comprising:

a circumferential outermost heel row of wear resistant inserts;

a circumferential second row of wear resistant chisel shaped inserts with elongated crests, the second row being adjacent to the inward side of the heel row;

the chisel shaped inserts of the second row being oriented with the elongated crests at an azimuth direction from about 300 to 330 degrees from the axis of rotation of the cone cutter; and a plurality of circumferential inner rows of wear resistant chisel shaped inserts, the inner rows being adjacent to the inward side of the second row of inserts.

9. The improved roller cone cutter of claim 8 wherein the chisel shaped inserts of the inner rows are oriented at an azimuth direction to the axis of rotation of the cone cutter according to the direction of scraping action for the inner rows.

10. The improved roller cone cutter of claim 8 wherein the inserts of the heel row are comprised of dome, conical or blunt chisel inserts.

11. An improved roller cone cutter, the cutter being adapted for mounting on a bearing pin shaft on a roller cone rock drill bit, the axis of rotation of the improved cutter extending inwardly and through the center of the bearing pin shaft toward and offset from the axis of rotation of the drill bit, the improved roller cone cutter comprising:

a circumferential outermost heel row of wear resistant chisel shaped inserts with elongated crests;

the chisel shaped inserts in the heel row being oriented with the elongated crests at an angle from about 30 to 60 degrees from the axis of rotation of the cone cutter toward the leading side of the cone cutter;

a circumferential second row of wear resistant chisel shaped inserts with elongated crests, the second row being adjacent to the inward side of the heel row;

the chisel shaped inserts in the second row being oriented with the elongated crests at an angle from about 30 to 60 degrees from the axis of rotation of the cone cutter towards the trailing side of the cone cutter; and a plurality of circumferential inner rows of wear resistant chisel shaped inserts, the inner rows being adjacent to the inward side of the second row of inserts.

12. The improved roller cone cutter of claim 11 wherein the chisel inserts of the inner rows are oriented at an azimuth direction to the axis of rotation of the cone cutter according to the direction of scraping action for the inner rows.

13. An improved roller cone cutter, the cutter being adapted for mounting on a bearing pin shaft on a roller cone rock drill bit, the axis of rotation of the improved cutter extending inwardly and through the center of the bearing pin shaft toward and offset from the axis of rotation of the drill bit, the improved roller cone cutter comprising:

a circumferential outermost heel row of wear resistant inserts;

a circumferential second row of wear resistant chisel shaped inserts with elongated crests, the second row being adjacent to the inward side of the heel row;

the chisel shaped inserts in the second row being oriented with the elongated crests at an angle from about 30 to 60 degrees from the axis of rotation of the cone cutter towards the trailing side of the cone; and a plurality of circumferential inner rows of wear resistant chisel shaped inserts, the inner rows being adjacent to the inward side of the second row of inserts.

14. The improved roller cone cutter of claim 13 wherein the chisel shaped inserts of the inner rows are oriented at an azimuth direction to the axis of rotation of the cone cutter according to the direction of scraping action for the inner rows.

15. The improved roller cone cutter of claim 13 wherein the inserts of the heel row are comprised of dome, conical, or blunt chisel inserts.

16. An improved roller cone cutter, the cutter being adapted for mounting on a bearing pin shaft on a roller cone rock drill bit, the axis of rotation of the improved cutter extending inwardly and through the center of the bearing pin shaft toward and offset from the axis of rotation of the drill bit, the improved roller cone cutter comprising:

a circumferential outermost heel row of wear resistant chisel shaped inserts with elongated crests;

the chisel shaped inserts in the heel row being oriented with the elongated crests at an angle from about 30 to 60 degrees from the axis of rotation of the cone cutter toward to the trailing side of the cone cutter;

a circumferential second row of wear resistant chisel shaped inserts with elongated crests, the second row being adjacent to the inward side of the heel row;

the chisel shaped inserts in the second row being oriented with the elongated crests at an angle from about 30 to 60 degrees from the axis of rotation of the cone cutter toward the leading side of the cone cutter; and a plurality of circumferential inner rows of wear resistant chisel shaped inserts, the inner rows being adjacent to the inward side of the second row of inserts.

17. The improved roller cone cutter of claim 16 wherein the chisel shaped inserts of the inner rows are oriented at an azimuth direction to the axis of rotation of the cone cutter according to the direction of scraping action for the inner rows.

18. An improved roller cone cutter, the cutter being adapted for mounting on a bearing pin shaft on a roller cone rock drill bit, the axis of rotation of the improved cutter extending inwardly and through the center of the bearing pin shaft toward and offset from the axis of rotation of the drill bit, the improved roller cone cutter comprising:

a circumferential outermost heel row of wear resistant inserts;

a circumferential second row of wear resistant chisel shaped inserts with elongated crests, the second row being adjacent to the inward side of the heel row;

the chisel shaped inserts of the second row being oriented with the elongated crests at an angle from about 30 to 60 degrees from the axis of rotation of the cone cutter towards the leading side of the cone cutter; and a plurality of circumferential inner rows of wear resistant chisel shaped inserts, the inner rows being adjacent to the inward side of the second row of inserts.

19. The improved roller cone cutter of claim 18 wherein the inserts of the heel row are comprised of dome, conical, or blunt chisel inserts.

20. The improved roller cone cutter of claim 18 wherein the chisel shaped inserts of the inner rows are oriented at an azimuth direction to the axis of rotation of the cone cutter according to the direction of scraping action for the inner rows.

21. An improved roller cone rock drill bit comprising:

two or more roller cone cutters;

the roller cone cutters being adapted for mounting on bearing pin shafts;

the roller cone cutters having axes of rotation extending inwardly and through the center of the bearing pin shafts toward and offset from the axis of rotation of the drill bit;

the roller cone cutters having circumferential outermost heel rows of milled steel teeth;

the milled steel teeth in the heel rows oriented at an azimuth direction from about 30 to 60 degrees from the axes of rotation of the cone cutters; and the roller cone cutters having one or more circumferential inner rows of milled steel teeth, the inner rows being adjacent to the inward side of the heel rows of milled steel teeth.

22. The improved roller cone rock drill bit of claim 21 wherein the milled steel teeth in the inner rows are oriented at an azimuth direction to the axes of rotation of the cone cutters according to the direction of the scraping action for the inner rows.

23. An improved roller cone rock drill bit comprising:

two or more roller cone cutters;

the roller cone cutters being adapted for mounting on bearing pin shafts;

the roller cone cutters having axes of rotation extending inwardly and through the center of the bearing pin shafts toward and offset from the axis of rotation of the drill bit;

the roller cone cutters having circumferential outermost heel rows of milled steel teeth;

the milled steel teeth in the heel rows oriented at an azimuth direction from about 300 to 330 degrees from the axes of rotation of the cone cutters; and the roller cone cutters having one or more circumferential inner rows of milled steel teeth, the inner rows being adjacent to the inward side of the heel rows of milled steel teeth.

24. The improved roller cone rock drill bit of claim 23 wherein the milled steel teeth of the inner rows are oriented at an azimuth direction to the axes of rotation of the cone cutters according to the direction of the scraping action for the inner rows.

* * * * *